US011317694B2

(12) United States Patent
Choi

(10) Patent No.: US 11,317,694 B2
(45) Date of Patent: May 3, 2022

(54) EYE LINER

(71) Applicant: OUTINFUTURES CO., LTD., Seoul (KR)

(72) Inventor: Youngwook Choi, Seoul (KR)

(73) Assignee: OUTINFUTURES CO., LTD., Seoul (KR)

( * ) Notice: Subject to any disclaimer, the term of this patent is extended or adjusted under 35 U.S.C. 154(b) by 23 days.

(21) Appl. No.: 16/815,326

(22) Filed: Mar. 11, 2020

(65) Prior Publication Data

US 2020/0205546 A1 Jul. 2, 2020

Related U.S. Application Data

(63) Continuation of application No. PCT/KR2018/012836, filed on Oct. 26, 2018.

(30) Foreign Application Priority Data

Oct. 26, 2017 (KR) ..... 10-2017-0140066
Apr. 18, 2018 (KR) ..... 10-2018-0044827

(51) Int. Cl.
*B43K 8/06* (2006.01)
*A45D 34/04* (2006.01)
*A45D 40/20* (2006.01)

(52) U.S. Cl.
CPC ..... *A45D 34/04* (2013.01); *A45D 40/20* (2013.01); *A45D 2040/204* (2013.01); *A45D 2200/1072* (2013.01)

(58) Field of Classification Search
CPC .. A45D 34/04; A45D 40/20; A45D 2040/204; A45D 2200/1072
USPC ..... 401/198
See application file for complete search history.

(56) References Cited

U.S. PATENT DOCUMENTS 9,314,087 B2 * 4/2016 Ishida ..... A45D 34/04
9,908,362 B2 3/2018 Yasumi
2014/0360525 A1 12/2014 Uehara
2016/0374454 A1 * 12/2016 Liu ..... A45D 34/042 401/198
2018/0146766 A1 5/2018 Prade et al.
(Continued)

FOREIGN PATENT DOCUMENTS

JP 2012-100968 A 5/2012
JP 2013163016 A 8/2013
JP 2017029511 A 2/2017
(Continued)

OTHER PUBLICATIONS

Internation Search Report of PCT/KR2018/012836, dated Feb. 8, 2019.
(Continued)

*Primary Examiner* — Jennifer C Chiang
(74) *Attorney, Agent, or Firm* — W&KIP

(57) ABSTRACT

An eye liner has a liquid solution accommodating portion which accommodates an eye liner fluid; an applicator part which is provided so as to be in communication with the liquid solution accommodating portion and is for the impregnation of the eye liner fluid accommodated in the liquid solution accommodating portion; and a holder which is provided on the outer surface of the applicator part, the eye liner being characterized in that the holder is provided with a plurality of holder open-portions.

18 Claims, 9 Drawing Sheets

(56) References Cited

U.S. PATENT DOCUMENTS

2018/0146767 A1 5/2018 Prade

FOREIGN PATENT DOCUMENTS

| | | | |
|---|---|---|---|
| KR | 20-0450582 | Y1 | 10/2010 |
| KR | 200478997 | Y1 | 12/2015 |
| KR | 1020180017024 | A | 2/2018 |
| WO | 201600189168 | A1 | 12/2016 |

OTHER PUBLICATIONS

International Preliminary Report on Patentability of PCT/KR2018/012836, dated Feb. 8, 2019.
First Office Action of Korean Application No. 10-2018-0044827.

* cited by examiner

EYE LINER

CROSS-REFERENCE TO RELATED APPLICATIONS

This application is a continuation of International Patent Application No. PCT/KR2018/012836 with a filing date of Oct. 26, 2018, designating the United States, now pending, and further claims priority to Korean Patent Application No. 10-2017-0140066 with a filing date of Oct. 26, 2017 and Korean Patent Application No. 10-2018-0044827 with a filing date of Apr. 18, 2018. The content of the aforementioned applications, including any intervening amendments thereto, are incorporated herein by reference.

TECHNICAL FIELD

The present application relates to an eye liner.

BACKGROUND

Generally, eye makeup can be generally divided into: eyelash makeup, applying mascara liquid on eyelashes to make the eyelashes dense; and eyeliner makeup, applying eye liner fluid around eyes to make eye contours clear.

In the eyeliner makeup, when the eye contours are drawn, it is necessary to draw the eye contours thinly at a time to make the eyes look naturally larger, so as to achieve beautiful eye makeup.

FIG. 1 is a view showing an existing eye liner. The existing eye liner may include: a liquid solution accommodating portion 1 for accommodating an eye liner fluid; and an applicator part 2 for applying the eye liner fluid accommodated in the liquid solution accommodating portion 1 to the user's eyeliner T. In this case, generally, the applicator part 2 may be composed of a fiber bundle such as a brush, or may be composed of a felt material such as a pen tip of a highlighter.

In the existing applicator part 2, the outer peripheral surface of the applicator part 2 does not have a structure for supporting the applicator part. Therefore, it is difficult for a new user to draw a desired eyeliner using the applicator part 2.

In addition, as shown in FIG. 1, when an eye liner solution is applied to a user's eyeliner T by using an existing eye liner, there is a problem that an end of the applicator part 2 is cracked due to an external force, i.e. a deformation force (stress) applied to an end of the applicator part 2 continually.

On the one hand, the eye liner composed of a variety of colors and mainly made in liquid, has content of a liquid cosmetic pigment prepared by mixing yellow iron oxide, green iron oxide, blue iron oxide, red iron oxide, and brown iron oxide in addition to black color oxidized steel used as fine particles of inorganic pigment, which is harmless to human body.

However, due to differences in molecular weight or specific gravity of the above various iron oxides, it is difficult to maintain a predetermined viscosity or concentration. Therefore, when a structurally stable product cannot be supplied, the color may be ununiform during makeup, so that there is a problem that it is very difficult to present various colors.

In addition, when the eye liner is placed horizontally, the eye liner fluid in a content storage section detains under an axial direction of a connecting core, and thus the eye liner fluid cannot be continuously supplied to the brush at a predetermined concentration ratio through the connecting core, resulting in a problem that it is difficult to maintain a uniform makeup state due to an unstable supply of eye liner fluid.

In addition, when the eye liner is not used for a long time, it is difficult to maintain the residual eye liner fluid mixed with various pigments at a predetermined concentration ratio. When the eye liner fluid supplied to the brush is interrupted and the brush is dried, it also causes problems such as a decrease in use convenience when used again.

Contents described in background are used to increase an understanding of the background of the present application, and may also include contents other than the prior art known to those skilled in the art.

SUMMARY

Technical Problem to be Solved

The technical problem to be solved by the present application is to provide an eye liner that can draw eyeliner above average quality regardless of a makeup level of an user.

In addition, the technical problem to be solved by the present application is to provide an eye liner, which prevents a problem that one end of an applicator part for applying eye liner fluid is cracked due to continuous use of the eye liner.

In addition, the technical problem to be solved by the present application is to provide an eye liner, so ad to achieve a uniform dispersion of a cosmetic composition transferred to an application tip.

The technical problems to be solved in the present application are not limited to the above-mentioned technical problems. Those skilled in the art can clearly understand other technical problems that are not involved based on the following description.

Technical Means to Solve Problems

In order to solve the above problems, the present application provides an eye liner, comprising a liquid solution accommodating portion, for accommodating an eye liner fluid; an applicator part, being in communication with the liquid solution accommodating portion for an impregnation of the eye liner fluid accommodated in the liquid solution accommodating portion; and a holder, provided on an outer surface of the applicator part, wherein the holder is provided with a plurality of holder open-portions.

Furthermore, in the eye liner, the plurality of holder open-portions are disposed at mutually symmetrical positions.

Furthermore, in the eye liner, the plurality of holder open-portions have a streamline shape.

Furthermore, in the eye liner, the plurality of holder open-portions include: a first holder open-portion, formed on one side of the holder; a second holder open-portion, formed on other side of the holder; and a third holder open-portion, formed at front end of the holder and used to connect the first holder open-portion and the second holder open-portion.

Furthermore, in the eye liner, the first holder open-portion and the second holder open-portion have one end with a width of 0.2-0.7 mm.

Furthermore, in the eye liner, the first holder open-portion and the second holder open-portion have another end with a width of 0.7 mm or less.

Furthermore, in the eye liner, the first holder open-portion and the second holder open-portion have a maximum width of 1-2 mm.

Furthermore, in the eye liner, a part of a front end portion of the first holder open-portion and the second holder open-portion has the same width as that of the third holder open-portion.

Furthermore, in the eye liner, an exposed portion of the applicator part exposed through the plurality of holder open-portions has the same radius of curvature as that of the holder at the same latitude.

Furthermore, in the eye liner, the applicator part is made of felt material.

In addition, in order to solve the above problems, the present application provides an eye liner, comprising: a casing; a sponge, inserted into an interior of the casing for an impregnation of a cosmetic composition; a cosmetic material transmitting portion, for transmitting the cosmetic composition impregnated in the sponge to an application tip; the application tip, being in surface contact with at least a part of one end of the cosmetic material transmitting portion for absorbing the cosmetic composition transmitted to the cosmetic material transmitting portion; and a tip guide part, including an exposed portion provided to expose at least a part of an outer peripheral surface of the application tip part to the outside thereof, and used for supporting the application tip exposed.

Furthermore, in the eye liner, the application tip has a thin sheet shape, and a thickness gradually decreasing toward the end thereof.

Furthermore, in the eye liner, the cosmetic material transmitting portion includes: an application tip accommodating portion, for accommodating one end of the application tip; and at least one accommodation guide portion, for supporting at least one side of the application tip accommodated in the application tip accommodating portion.

Furthermore, in the eye liner, the application tip is in surface contact with the application tip accommodating portion and the at least one accommodation guide portion.

Furthermore, in the eye liner, the application tip includes: a first region, having a constant height from a position accommodated in the application tip accommodation portion; and a second region, starting from a position where the first region ends and ending at an end of the application tip, and having a gradually decreasing height.

Furthermore, in the eye liner, the first region has a height of 1-2 mm.

Furthermore, in the eye liner, the tip guide portion includes at least one application tip support portion protruding toward a tip region of the application tip to support at least one side of the application tip.

Furthermore, in the eye liner, the application tip support portion extends to the second region of the application tip.

Furthermore, in the eye liner, the tip guide portion is provided to expose a half of the first region of the application tip to the outside.

Furthermore, in the eye liner, the application tip includes: at least one concave portion, sinking with a predetermined height in the tip region; and at least one concave portion, protruding with a predetermined height in the tip region.

Furthermore, in the eye liner, the at least one concave portion and the at least one convex portion are alternately arranged in order.

Furthermore, in the eye liner, the application tip is provided with the convex portion on both ends thereof.

Furthermore, in the eye liner, the convex portion provided at both ends of the application tip has a side surface with a shape whose height gradually decreases and converges to 0.

Furthermore, in the eye liner, the application tip includes: a first region, having a constant height from a position accommodated in the application tip accommodation portion; and a second region, starting from a position where the first region ends and ending at an end of the application tip, and having a cylinder shape.

Furthermore, in the eye liner, a minimum length of a diameter of the second region is the same as a maximum length of a section of the first region.

Technical Effects

An eye liner of the present application can draw eyeliner above average quality regardless of a makeup level of an user.

In particular, even if the user is new user, the user can draw the eyeliner with a width and shape of the eyeliner on both sides of the eye without major deviation.

In addition, the eye liner of the present application can prevent a problem that one end of an applicator part for applying eye liner fluid is cracked due to continuous use of the eye liner, so as to extend a service life of the eye liner.

The technical effects obtained by the present application are not limited to the above-mentioned technical effects. Those skilled in the art can clearly understand other technical effects that are not involved based on the following description.

DETAILED DESCRIPTION OF THE EMBODIMENTS

Figure 1:
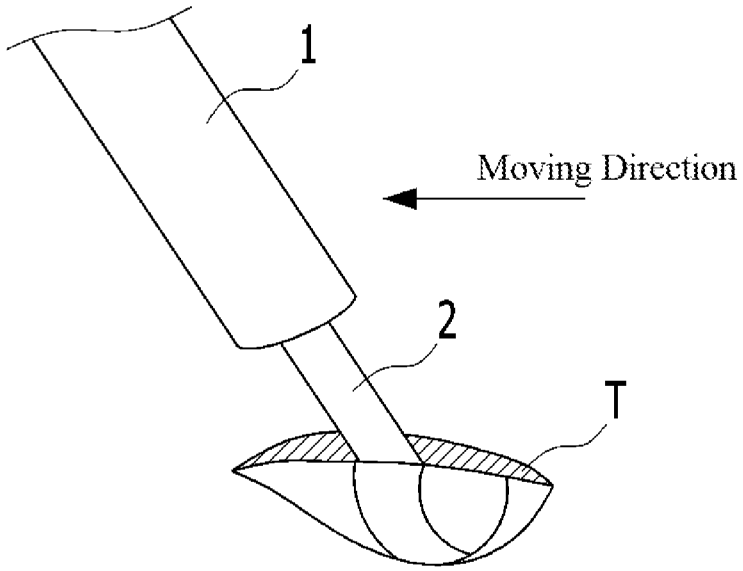
FIG. 1 is a view showing an existing eye liner.

Hereinafter, embodiments of the present application will be described in detail with reference to the drawings, so that those skilled in the art can easily implement the embodiments. However, the present application is not limited to the illustrated embodiments, and can be implemented in many different ways. Moreover, in order to clearly explain the present application in the drawings, parts irrelevant to the description are omitted, and a same part is demonstrated by using a same reference numeral in the specification.

Throughout the specification, when describing a certain part "comprise/include" a certain element, it does not mean to exclude other elements, but means to include other components, unless specifically stated otherwise. In addition, the similar element is demonstrated by using the similar reference numeral in the specification.

Sizes and thicknesses of structures shown in the drawings are shown for convenience of explanation, so the present application is not limited to contents shown in the drawings. In order to clearly show parts and regions of the structures, the thicknesses can be enlarged.

In addition, throughout the specification, when describing a certain part "includes" a certain element, it does not mean to exclude other elements, but means to include other components, unless specifically stated otherwise.

Moreover, "unit", "member", "part", "portion" and "component" described in the specification belong to a unit of a structure that can perform a summary of one or more functions or operations.

Figure 2:
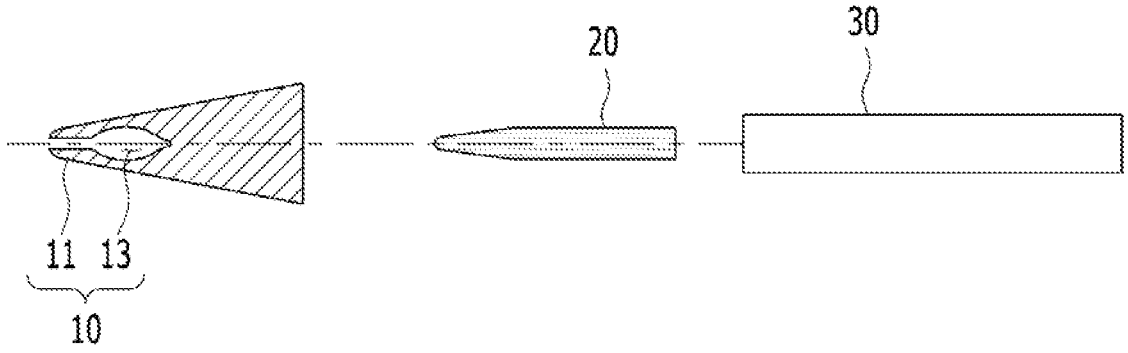
FIG. 2 is an exploded perspective view showing an eye liner according to an embodiment of the present application.
Figure 3:
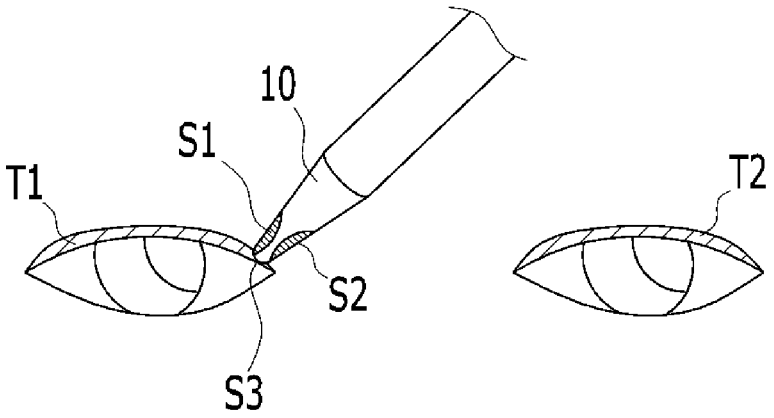
FIG. 3 is a view showing an example in which an eye liner is drawn on a user's eye using an eye liner according to an embodiment of the present application.
Figure 4:
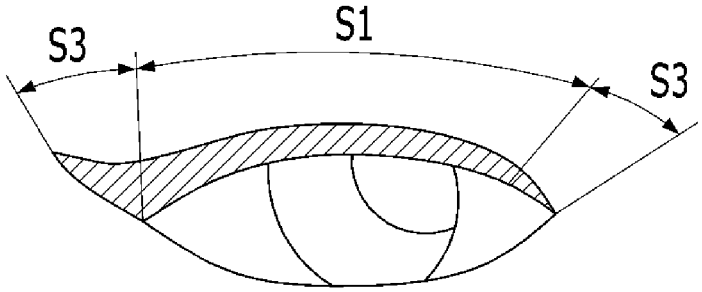
FIG. 4 is a view showing a method in which an exposed surface of an eye liner according to an embodiment of the present application contacts an eyeliner of a user.

FIG. 2 is an exploded perspective view showing an eye liner according to an embodiment of the present application. FIG. 3 is a view showing an example in which an eye liner is drawn on a user's eye using an eye liner according to an embodiment of the present application. FIG. 4 is a view showing a method in which an exposed surface of an eye liner according to an embodiment of the present application contacts an eyeliner of a user.

As shown in FIG. 2, an eye liner of the embodiment may comprises: a liquid solution accommodating portion 30 for accommodating an eye liner fluid; an applicator part 20 being in communication with one end of the liquid solution accommodating portion 30 for an impregnation of the eye liner fluid accommodated in the liquid solution accommodating portion 30, so as to apply the eye liner fluid to the eyeliner of the user; and a holder 10 surrounding outside of the applicator part 20 and making a part of the applicator part 20 expose outside.

The liquid solution accommodating portion 30 is a component used for makeup and held by a user's hand, and has an opening at one end and is closed at the other end, so that the eye liner fluid can be stored inside thereof.

This liquid solution accommodating portion 30 has a storage space for accommodating the eye liner fluid inside thereof, and can be formed into a cylinder shape with a predetermined length so that the user can easily hold it.

However, the shape of the liquid solution accommodating portion 30 described above is described as an example for convenience of description. The user may make various modification to the shape of the liquid solution accommodating portion 30 according to needs, which does not limit protection scopes of the present application.

One end of the applicator part 20 is a cylinder shape, and may be set in a shape with a width gradually narrowing toward a front end.

In addition, the applicator part 20 may be made of a material such as felt that can absorb eye liner fluid and contained therein.

The holder 10 may be configured to be combined with one end having the opening of the liquid solution accommodating portion 30 at one end, and make the partial surface of the applicator part 20 accommodated inside expose outside at the other end.

The holder 10 may have a hollow cylinder shape, which has a width gradually narrows toward one exposed end of the partial surface of the applicator part 20, and the same width of the other end as that of the liquid solution accommodating portion 30.

In one aspect, the holder 10 may include: a holder body 11 formed to prevent an outer peripheral surface of the applicator part 20 from being exposed to the outside; and a holder open-portion 13 provided in such a way to make the outer peripheral surface of the applicator part 20 expose to the outside.

This holder open-portion 13 may be configured to make the applicator part 20 inserted into the holder 10 to form three exposed portions (see FIG. 4).

Hereinafter, as shown in FIGS. 2-5, the holder open-portion 13 is provided in such a way to form a structure of the applicator part 20 including a first exposed portion S1, the second exposed portion S2, and a third exposed portion S3, which will be described in detail.

The holder open-portion 13 of the embodiment may be configured such that the applicator part 20 includes the first exposed portion S1, the second exposed portion S2, and the third exposed portion S3. The first exposed portion S1 may be provided on a side of the holder 10, the second exposed portion S2 may be provided on a side opposite to that of the first exposed portion S1 of the holder 10, and the third exposed portion S3 may be provided at a tail end of the holder 10. The first exposed portion S1 may be connected to the second exposed portion S2.

More specifically, the first exposed portion S1 and the second exposed portion S2 may extend from the tail end of the holder 10 toward the liquid solution accommodating portion 30 by a predetermined length, and have cross-sectional shapes of generally streamline shape.

Correspondingly, the third exposed portion S3 can maintain a width of one end of the first exposed portion S1 and the second exposed portion S2, and is provided to connect the first exposed portion S1 and the second exposed portion S2.

By referring to FIG. 4, showing an example in which an eye liner is drawn on a user's eye using an eye liner according to an embodiment of the present application, so as to make it more clearly to understand an effect produced by providing the first exposed portion S1, the second exposed portion S2, and the third exposed portion S3 in the shape as described above at the position as described above.

When the user uses the eye liner of the embodiment to draw the eyeliner on the eye, the user should first draw a first line T1 of a left eye and then draw a second line T2 of a right eye.

With reference to a usual drawing of the eyeliner in a shape from narrow to wide and then to narrow, when drawing a narrow line first, the user can draw from the third exposed portion S3 disposed at the tip portion to the gradually widening first exposed portion S1, and end with the third exposed portion S3 having a narrowed area.

At this time, since the eye liner of the embodiment limits a maximum width of the first exposed portion S1, even a new user can draw a desired eyeliner without great deviation.

Further, after drawing the first line T1 of the left eye, when drawing the second line T2 of the right eye, the user can draw the eyeliner by using the second exposed portion S2 that is not used when the first line T1 of the left eye is drawn, thereby realizing an effect that the user can present the eyeliners of the right eye and the left eye in the same color.

In more detail, the user uses the existing eye liner made of felt tip to draw the eyeliner on one eye, and then uses the same surface to draw the eyeliner on the other eye, in this case the eye liner fluid has a reduced concentration in the tip, and impurities on one side of the eye surface are attached to the applicator part.

Therefore, there is a problem that colors of the eyeliners draw the eyes on both sides are different.

However, the eye liner of the embodiment of the present application uses different surface of the applicator part when drawing the eyeliners of the left eye and the right eye, thus preventing colors of the eyeliners draw the eyes on both sides from being different.

Figure 5:
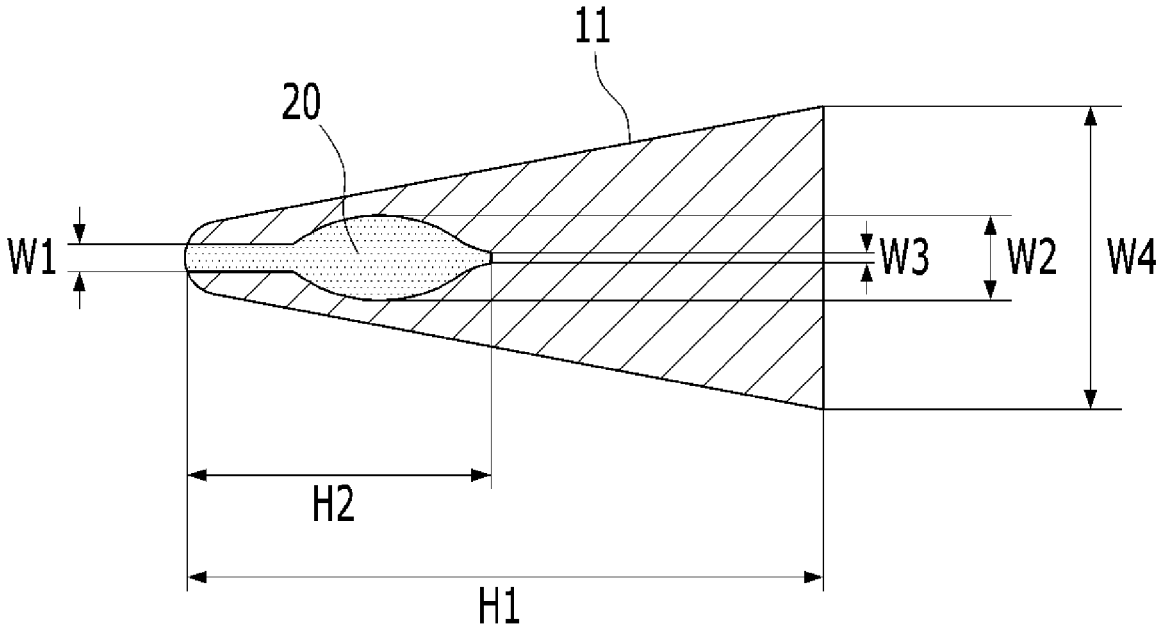
FIG. 5 is a view showing a combination of a holder and an applicator part of an eye liner according to another embodiment of the present application.

FIG. 5 is a view showing a combination of a holder and an applicator part of an eye liner according to another embodiment of the present application.

As shown in FIG. 5, in an embodiment, the applicator part 20 is combined inside the holder 10, the first exposed portion S1, the second exposed portion S2, and the third exposed portion S3 of the applicator part 20 can be exposed through the holder opening 13 of the holder 10.

FIG. 5 is a view showing a side surface of the eye liner of the embodiment. The exposed portion shown in the figure may be the first and third exposed portions S1 and S3 or the second and third exposed portions S2 and S3, and also can be assumed to be the first exposed portion S1 and the third exposed portion S3 for convenience of explanation.

One end of the first exposed portion S1 may be provided with a first width W1 of 0.2-0.7 mm.

This is because when the first width W1 is less than 0.2 mm, the end of the applicator part 20 has an excessively narrow width, it is difficult for the user to draw the desired tail end of the eyeliner at one time; or when the first width W1 exceeds 0.7 mm, the end of the applicator part 20 has a too wide width, it is difficult to show a sharp tail of the eyeliner.

The maximum width near the center of the first exposed portion S1 may be set with a second width W2 of 1-2 mm.

This is because the average maximum width of people's eyeliner is 1-2 mm. Therefore, when the second width W2 is less than 1 mm, the desired eyeliner cannot be presented with one-time drawing; when the second width W2 exceeds 2 mm, it is beyond the people's eyeliner, thus making it difficult to present a desired shape of the eyeliner.

The other end of the first exposed portion S1 may be provided with a third width W3 below 0.7 mm.

This is because when the third width W3 exceeds 0.7 mm, the end of the applicator part 20 has a too wide width, it is difficult to show a sharp tail of the eyeliner.

The end of the holder portion 10 may be provided with a fourth width W4 of 5-9 mm.

This is because the end of the holder portion 10 has substantially the same width as the liquid solution accommodating portion 30 providing a space for the user to hold. Therefore, when the fourth width W4 is less than 5 mm, the liquid solution accommodating portion 30 has a too thin thickness, thus it is difficult to perform the control desired by the user. When the fourth width W4 exceeds 9 mm, the liquid solution accommodating portion 30 has a too thick thickness, thus it is difficult for the user to hold it.

The length from one end to another end of the holder 10 may be provided with a first height h1 of 15 mm to 25 mm.

This is because it is related to the length of the applicator part 20 inserted into the holder 10. When the first height h1 has a length smaller or larger than that of the applicator part 20 generally used by the holder 10, the commonly used applicator part 20 cannot be directly used, so as to increase manufacturing costs.

The first exposed portion S1 can be formed from a front end of the holder portion 10 and is provided with a second height h2 of 4-15 mm.

This is because it is related to the length of the people' eyeliner. When the second height h2 is less than 4 mm, it is difficult to cover an entire center of the eyeliner, thus there is a problem that the center of the eyeliner cannot be drawn at one time. When the second height h2 exceeds 15 mm, the area of the exposed portion is unnecessarily large too much, and there is a problem that it is inconvenient for the user to draw the eyeliner.

Figure 6:
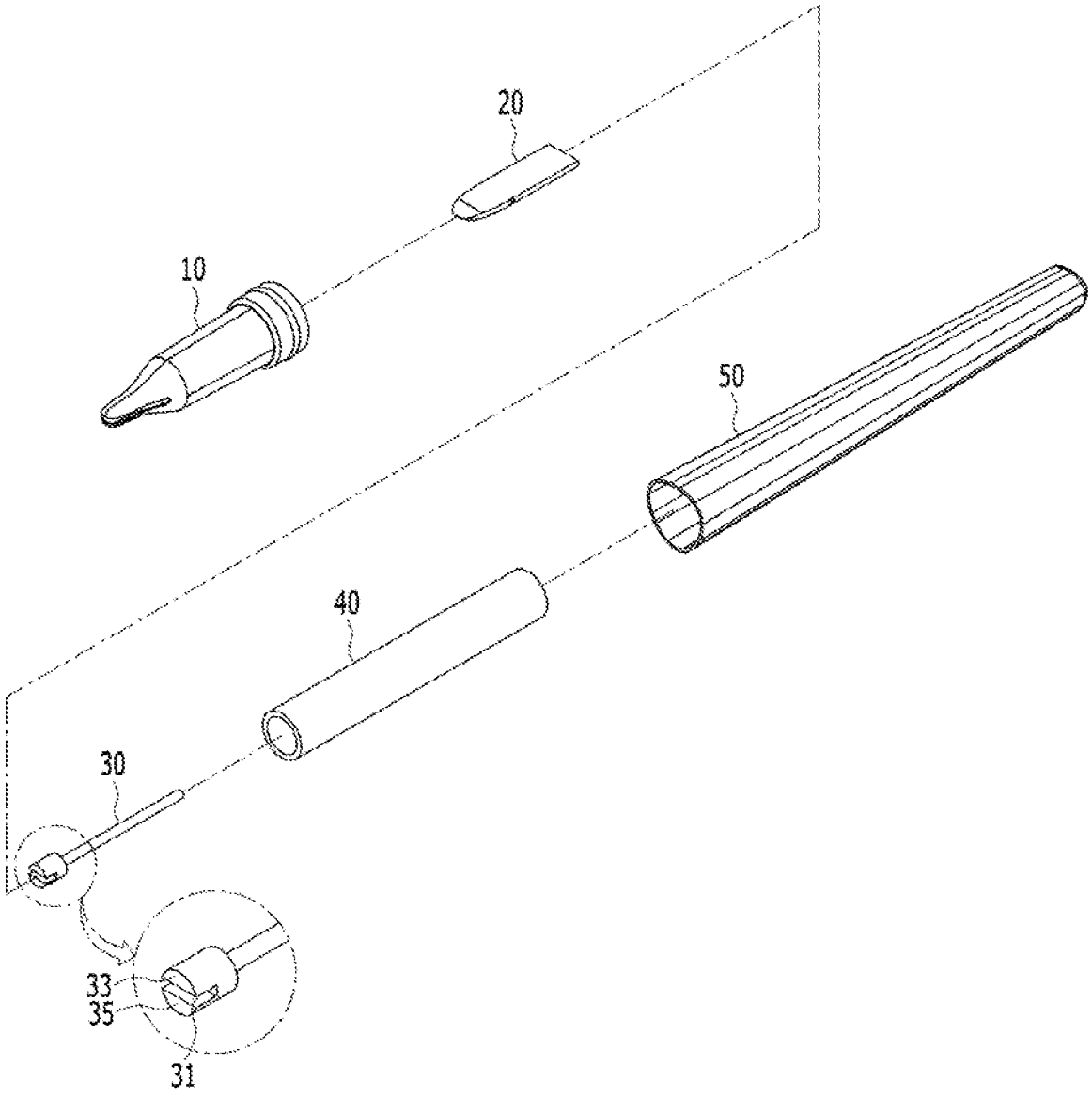
FIG. 6 is an exploded perspective view showing an eye liner according to another embodiment of the present application.

FIG. 6 is an exploded perspective view showing an eye liner according to another embodiment of the present application.

As shown in FIG. 6, the eye liner according to an embodiment of the present application may comprise: a casing 50, open on one side so as to provide a storage space for accommodating a sponge 40 inside, and closed on the other side; the sponge 40, inserted into an interior of the casing 50 for an impregnation of a cosmetic composition; a cosmetic material transmitting portion 30, for transmitting the cosmetic composition impregnated in the sponge 40 to an application tip 20; the application tip 20, being in surface contact with at least a part of one end of the cosmetic material transmitting portion 30 for absorbing the cosmetic composition transmitted to the cosmetic material transmitting portion; and a tip guide part 10, including an exposed portion provided to expose at least a part of an outer peripheral surface of the application tip part 20 to the outside thereof and used for supporting the application tip 20 exposed.

Figure 8:
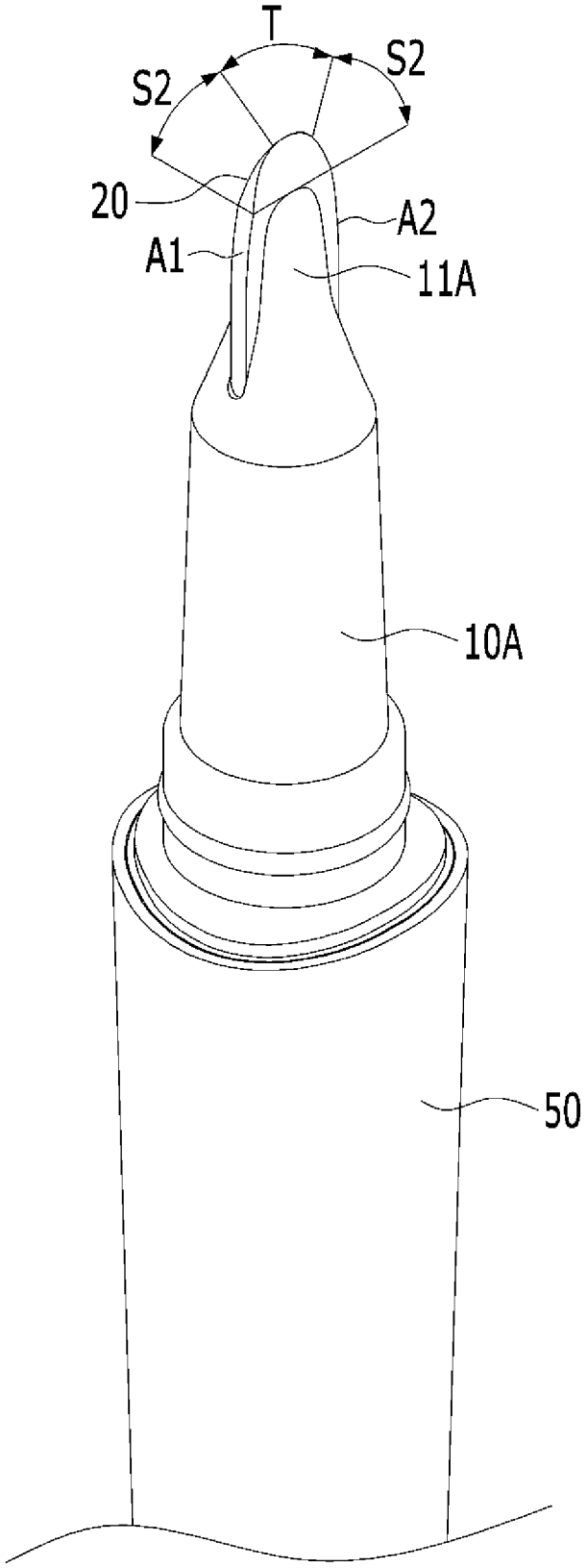
FIG. 8 is a view showing a state combining a tip guide part and an application tip with a casing of an eye liner according to another embodiment of the present application.
Figure 9:
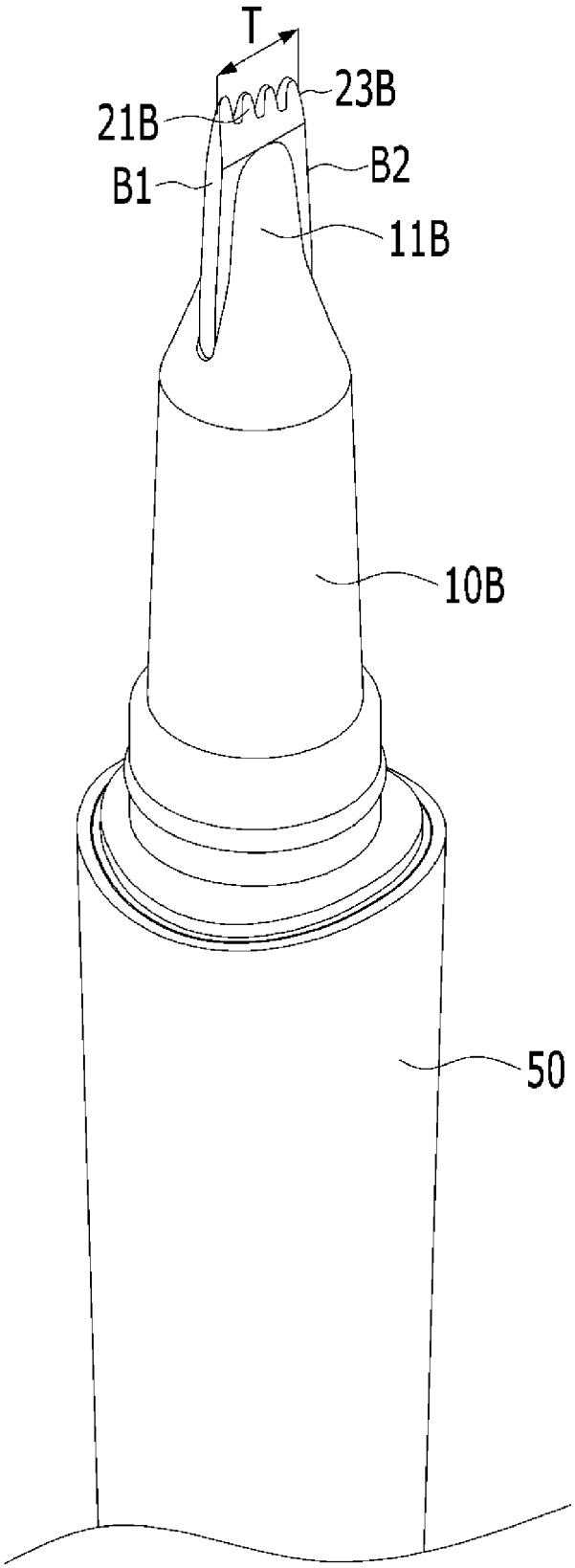
FIG. 9 is a view showing a state combining a tip guide part and an application tip with a casing of an eye liner according to another embodiment of the present application.

The tip guide part 10 of the embodiment is not explicitly illustrated in FIG. 6. Referring to FIGS. 8 and 9, the tip guide part 10 may further include an open portion inserted therein in a way that part of the application tip 20 protrudes to the outside. The combined structure of the tip guide part 10 and the application tip 20 will be described in detail below with reference to FIGS. 4 and 5.

The application tip 20 of the embodiment is provided in a shape of a thin plate with a thickness gradually reducing toward the end thereof.

This is because when the user uses the eye liner comprising an applicator part made of an existing fiber bundle such as a brush to apply a cosmetic composition to the eyes, in order to show the sharp tail of the eyeliner, an action of making small changes of the hand to reduce the application area of the applicator part is needed. Therefore, there is a problem that it is difficult to draw eyeliner of a predetermined quality according to the user's changing proficiencies or states.

However, unlike an existing eye liner, the application tip 20 of the embodiment is provided in a thin sheet shape and with a thickness gradually reducing toward the end, it can draw eyeliner with a predetermined thickness, thereby having an effect that the user can draw eyeliner of a predetermined quality regardless of the user's proficiency or state.

The cosmetic material transmitting portion 30 of the embodiment may include: an application tip accommodating portion 31 for accommodating one end of the application tip 20; a first accommodation guide portion 33 for supporting an upper portion of the application tip 20 accommodated in the application tip accommodating portion 31; and a second accommodation guide portion 35 for supporting a lower portion of the application tip 20 accommodated in the accommodation portion 31.

The existing eye liner is provided with a brush type composed of a fiber bundle such as a brush or a felt type composed of a cylindrical felt material used for a nib of a highlighter.

That is, in order to absorb a cosmetic composition from a sponge, the existing brush type or cylindrical felt type eye liner usually includes a cosmetic material transmitting portion that can be simply surface-contacted.

However, as described above, the eye liner of the present application is provided with an application tip 20 in a plate shape in order to allow the user to draw the eyeliner of a predetermined quality.

In order to effectively absorb the cosmetic composition into such an application tip 20, it is necessary to increase an area contacted with the application tip 20 and hold a component of the application tip 20 in a plate shape, respectively.

Thus, in order to achieve this effect, the cosmetic material transmitting portion 30 according to an embodiment of the present application may include an application tip accommodating portion 31 concaved from a side of the cosmetic material transmitting portion 30 at a prescribed height so as to provide a space for accommodating one end of the application tip 20 at a prescribed depth, and a first accommodation guide portion 33 and a second accommodation guide portion 35 for supporting the upper and lower surfaces of the accommodated application tip 20.

This has an effect of solving a problem involved in contact area and holding generating when using an application tip with a shape different from that of the existing application tip.

The sponge 40 of the embodiment may include an inner layer, accommodated inside the casing 50 and composed of a porous material, and an outer layer, formed of an impervious layer so as to prevent contents immersed in the inner layer from contaminating the interior of the casing 50.

This sponge 40 is made of a porous material, so as to be impregnated with the contents by a capillary phenomenon.

The casing 50 of the embodiment can be provided to be closed at one end and open at the other end. An open surface of the casing 50 can be combined with one end of the tip guide part 10 to accommodate the application tip 20, the cosmetic material transmitting portion 30, and sponge 40 inside.

In addition, in order to prevent evaporation of the cosmetic composition impregnated with the sponge 40, the casing 50 and the tip guide part 10 can be sealed to achieve sealing effect.

On the one hand, a cross section of the casing 50 shown in FIG. 6 is shown as a triangle shape with a vertex processed with a round head which is an example shown for convenience of explanation. The user can perform various deformations on the shape of the cross-section of the casing 50 according to needs, which is not intend to limit the protection scope of the present application.

Figure 7:
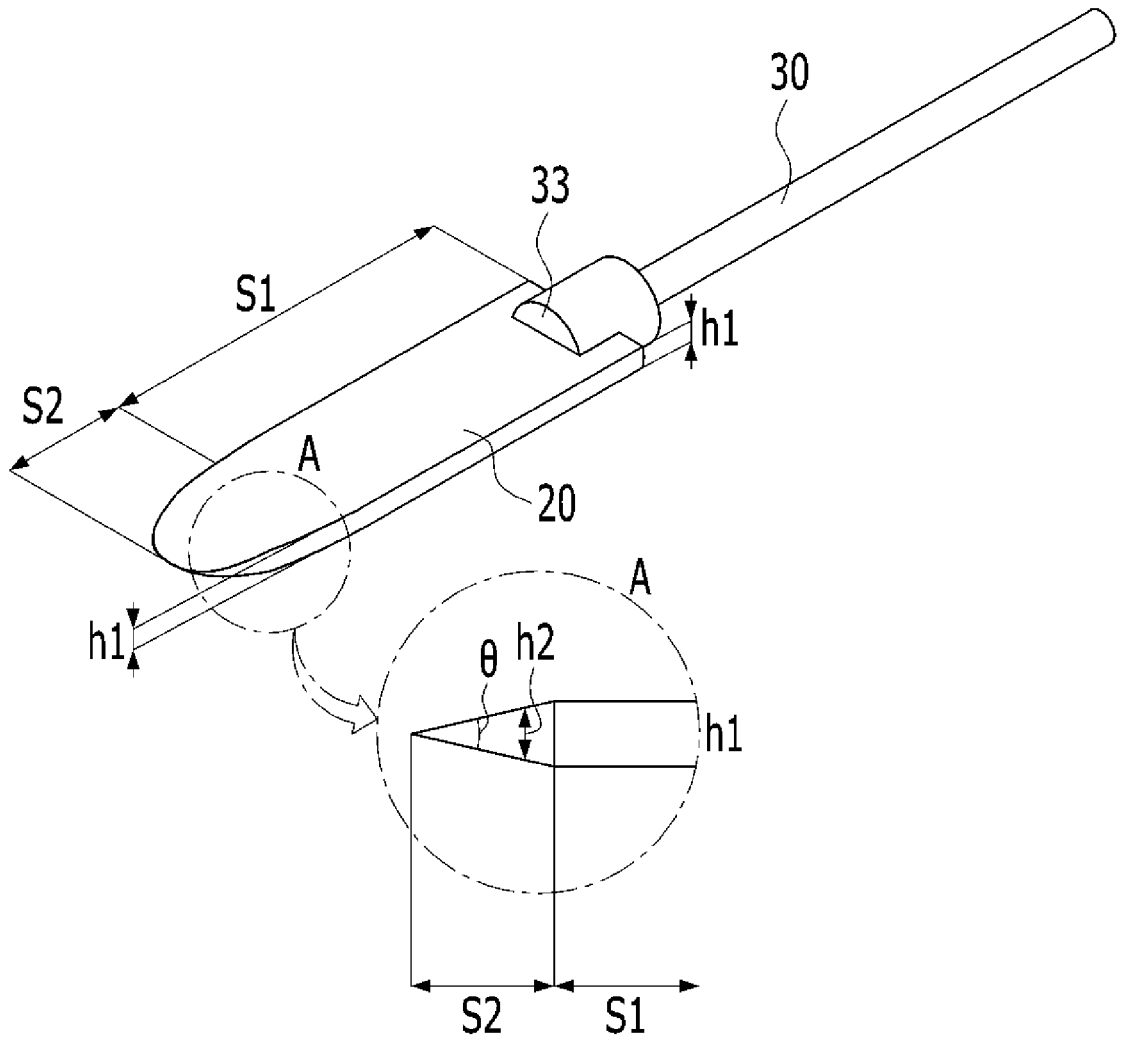
FIG. 7 is a view showing a state combining an application tip and a cosmetic material transmitting portion of an eye liner according to another embodiment of the present application.

FIG. 7 is a view showing a state combining an application tip and a cosmetic material transmitting portion of an eye liner according to another embodiment of the present application.

As shown in FIG. 7, as briefly explained above, the application tip 20 of the embodiment is accommodated in the application tip accommodating portion 31 of the cosmetic material transmitting portion 30, and can be fixedly supported by a first accommodation guide portion 33 and a second accommodation guide portion 35.

The application tip 20 of the embodiment can be generally divided into two regions.

A first region S1 is a region having a constant height h1 from a position of the application tip 20, accommodated in the application tip accommodation portion 31.

A second region S2 is a region starting from a position where the first region ends and ending at an end of the application tip 20, and a region that gradually decreases in height and is used by the user to draw the eyeliner.

The first region S1 may have a height h1 of 1-2 mm.

The first region S1 may have a height h1 that is the same as that of the starting position of the second region S2, which is a design considering that this region is a starting portion used by the user to draw the eyeliner.

For a specific explanation, the average maximum width of people's eyeliner is 1-2 mm.

Therefore, when the height h1 of the first region S1 is less than 1 mm, the desired eyeliner cannot be presented with one-time drawing; when the height h1 of the first region S1 exceeds 2 mm, it is beyond the people's eyeliner, thus making it difficult for to present a desired shape of the eyeliner.

Therefore, the height h1 of the first region S1 may be 1-2 mm, so that the user can present the eyeliner in a desired shape with the least amount of drawing.

In addition, by keeping the height h1 of the first region S1 constant, the cosmetic composition immersed in the sponge 40 can be uniformly absorbed into the application tip 20 integrally, and the concentration of the cosmetic composition absorbed to the application tip 20 can be kept constant.

The application tip 20 in the second region S2 has a height of gradually decreasing and converging to 0 at the end. Therefore, the side of the second region S2 of the application tip 20 may has a shape similar to an equilateral triangle.

Considering that the eyeliner is usually drawn in a shape from narrow to wide and then to narrow, this is a case drawing from a narrow line to a wide line, and then drawing from a wide line to a narrower line.

Therefore, the second region S2 of the present application includes a surface gradually widening or narrowing, thus there is an effect that the eyeliner can be easily presented with the least drawing.

In addition, a sharper look can be drawn by converging the height of the second region S2 to 0 at the end.

FIG. 7 shows that a shape of the side region of the second region S2 of the application tip 20 is an equilateral triangle with a predetermined angle θ, but this is only an example shown for convenience of explanation. The user can perform various deformations on the shape of the second region S2 of the application tip 20 having a height gradually converging to 0 from one end to the tail end, which does not limit the protection scope of the present application.

On the one hand, the application tip 20 of the eye liner of another embodiment can be generally divided into two regions.

As in the previously described embodiment, the first region is made of a thin plate shape with a height gradually decreasing toward the end.

The second region can be connected to the first region and provided in a cylinder shape.

That is, the first region and the second region are composed of one continuous body with a shape from the cylinder shape of the second region changing into a thin plate shape of the first region.

A part where the second region contacts the first region may have a diameter that is the same as or larger than a part where the first region contacts the second region. Considering that the second region is a cylinder shape instead of a thin plate shape, even if it has the same diameter as the first region, the cylinder shape has a volume that is much larger than that of the thin plate shape.

Therefore, the second region can be impregnated with more cosmetic composition, thus having an effect of using the eye liner of the embodiment to maintain the concentration of the cosmetic composition of the same quality for a longer period of time.

On the one hand, in addition to the cylinder shape, the second region can also have a conical shape, and can perform various deformation according to user's needs.

FIG. 8 is a view showing a state combining a tip guide part and an application tip with a casing of an eye liner according to another embodiment of the present application.

As shown in FIG. 8, the effect that the user uses the eye liner according to an embodiment of the present application to display eyeliner on the eyes will be described in detail.

With reference to a usual drawing of the eyeliner in a shape from narrow to wide and then to narrow, a half of the eyeliner can be drawn from a tip region T of the application tip 20, to the second region S2 having a first application surface A1 with a height gradually increasing; the other half of the eyeliner can be drawn by using the second region S2 having a second application surface A2 with a height gradually increasing.

In this case, the maximum height of the second region S2 which is also the height h1 of the first region S1, is limited to 1-2 mm. Therefore, even a new user can draw the desired eyeliner at one time without large deviation.

In addition, the eye liner of this embodiment can draw half of the eyeliner with the first application surface A1 and draw the remaining part of the eyeliner with the second application surface A2, so as to have the effect that a concentration of the cosmetic composition immersed in the application tip 20 is capable to draw the eyeliner with the same concentration.

In more detail, the user uses the existing eye liner made of felt tip to draw the eyeliner on one eye, and then use the same surface to draw the eyeliner on the other eye. At this time, the concentration of the eye liner fluid immersed in the tip is reduced, and impurities on one side of the eye surface are attached to the applicator part.

Therefore, there is a problem that the colors of the eyeliners drawn on both sides of eyes are different.

However, since the eye liner of the embodiment of the present application is used to draw the eyeliner of the left eye and the right eye with different surface of the applicator part, it is possible to prevent the color of the eyeliner of the two eyes from being different.

The tip guide part 10 of this embodiment may include at least one application tip support portion 11A protruding toward the tip region T of the application tip 20 so as to support at least one surface of the application tip 20.

Since the application tip 20 of the embodiment is provided in the shape of a plate shape, which is different from the existing cylindrical application tip used in the eye liner, so there is a problem of bending deformation due to an external force applied during use.

Therefore, in order to prevent the deformation of the application tip 20 with a plate shape, the tip guide part 10 of this embodiment may include at least one application tip support portion 11A for supporting at least one surface of the application tip 20.

The application tip support portion 11A may be configured to extend from the tip guide part 10 to the second region S2 of the application tip 20, and the tip guide part 10 is disposed in such a way that allows a half position of the first region S1 of the application tip 20 to be exposed to the outside.

This can prevent the application tip 20 from being bent due to a vertical force applied to the second region S2 of the application tip 20.

Furthermore, by offsetting the moment occurring when the user draws the eyeliner using the second region S2 of the application tip 20, the application tip 20 can be prevented from being rotated.

FIG. 9 is a view showing a state combining a tip guide part and an application tip with a casing of an eye liner according to another embodiment of the present application.

As shown in FIG. 9, the eye liner of the present embodiment has the similar structure with the structures described in FIGS. 6-8 except the application tip, so only the application tip will be described.

The application tip 20 of the eye liner includes: at least one concave portion 21B, sinking with a predetermined height in the tip region T; and at least one concave portion 23B, protruding with a predetermined height in the tip region T.

In addition, the at least one concave portion 21B and the concave portion 23B may be alternately arranged in order.

Previously, the tip region T of the eye liner having the application tip 20 described with reference to FIGS. 6-8 was used to sharply treat the end of the eyeliner.

However, as shown in FIG. 9, the application tip 20 of the eye liner is provided with the tip region T having at least one concave portion 21B and concave portion 23B arranged alternately, which plays the role of a brush.

Therefore, the user can use the tip region T having the concave portion 21B and a concave portion 23B to use the eye liner of the present application as a dedicated eyebrow pencil.

More specifically, the user can draw the eyeliner using the first application surface B1 and the second application surface B2 of the application tip 20, and can draw the eyebrows using the concave portion 21B and the concave portion 23B of the tip region T provided in the application tip 20, thereby achieving an effect used as the eye liner and the eyebrow pencil at the same time using one tool.

The above embodiments are used to describe the present application, but are merely illustrative and do not limit the present application. It can be understood that those skilled in the art may perform each of the unillustrated variations and applications without departing from the essential characteristics of the present application. For example, each element specifically appearing in the embodiment may be modified and implemented. Furthermore, such differences related to the variations and applications can be interpreted as encompassing the scope of the present application determined by the claims.

INDUSTRIAL APPLICABILITY

The present application relates to a structure of eye liner, and has the industrial application possibility in a field of eye liner of cosmetics.

I claim:

1. An eye liner, comprising a liquid solution accommodating portion, for accommodating an eye liner fluid;

an applicator part, being in communication with the liquid solution accommodating portion for an impregnation of the eye liner fluid accommodated in the liquid solution accommodating portion; and a holder, provided on an outer surface of the applicator part, wherein the holder is provided with a plurality of holder open-portions;

wherein the plurality of holder open-portions include:

a first holder open-portion, formed on one side of the holder;

a second holder open-portion, formed on other side of the holder; and a third holder open-portion, formed at front end of the holder, and used to connect the first holder open-portion and the second holder open-portion.

2. The eye liner according to claim 1, wherein the plurality of holder open-portions are disposed at mutually symmetrical positions; and/or the plurality of holder open-portions have a streamline shape.

3. The eye liner according to claim 1, wherein the first holder open-portion and the second holder open-portion have one end with a width of 0.2-0.7 mm.

4. The eye liner according to claim 3, wherein the first holder open-portion and the second holder open-portion have another end with a width of 0.7 mm or less.

5. The eye liner according to claim 1, wherein the first holder open-portion and the second holder open-portion have a maximum width of 1-2 mm.

6. The eye liner according to claim 1, wherein a part of a front end portion of the first holder open-portion and the second holder open-portion has the same width as that of the third holder open-portion.

7. The eye liner according to claim 1, wherein an exposed portion of the applicator part exposed through the plurality of holder open-portions has the same radius of curvature as that of the holder at the same latitude.

8. The eye liner according to claim 1, wherein the applicator part is made of felt material.

9. An eye liner, comprising:

a casing;

a sponge, inserted into an interior of the casing for an impregnation of a cosmetic composition;

a cosmetic material transmitting portion, for transmitting the cosmetic composition impregnated in the sponge to an application tip;

the application tip, being in surface contact with at least a part of one end of the cosmetic material transmitting portion for absorbing the cosmetic composition transmitted to the cosmetic material transmitting portion; and a tip guide part, including an exposed portion provided to expose at least a part of an outer peripheral surface of the application tip part to the outside thereof, and used for supporting the application tip exposed;

wherein the application tip includes:

at least one concave portion, sinking with a predetermined height in the tip region; and at least one concave portion, protruding with a predetermined height in the tip region;

preferably, the at least one concave portion and the at least one convex portion are alternately arranged in order.

10. The eye liner according to claim 9, wherein the application tip has a thin sheet shape, and a thickness gradually decreasing toward the end thereof.

11. The eye liner according to claim 10, wherein the cosmetic material transmitting portion includes:

an application tip accommodating portion, for accommodating one end of the application tip; and at least one accommodation guide portion, for supporting at least one side of the application tip accommodated in the application tip accommodating portion; preferably, the application tip is in surface contact with the application tip accommodating portion and the at least one accommodation guide portion.

12. The eye liner according to claim 9, wherein the application tip includes:

a first region, having a constant height from a position accommodated in the application tip accommodation portion; and a second region, starting from a position where the first region ends and ending at an end of the application tip, and having a gradually decreasing height.

13. The eye liner according to claim 12, wherein the first region has a height of 1-2 mm.

14. The eye liner according to claim 12, wherein the tip guide part includes at least one application tip support portion protruding toward a tip region of the application tip to support at least one side of the application tip;

preferably, the application tip support portion extends to the second region of the application tip;

preferably, the tip guide part is provided to expose a half of the first region of the application tip to the outside.

15. The eye liner according to claim 9, wherein the application tip is provided with the convex portion on both ends thereof.

16. The eye liner according to claim 15, wherein the convex portion provided at both ends of the application tip has a side surface with a shape whose height gradually decreases and converges to 0.

17. The eye liner according to claim 9, wherein the application tip includes:

a first region, having a constant height from a position accommodated in the application tip accommodation portion; and a second region, starting from a position where the first region ends and ending at an end of the application tip, and having a cylindrical shape.

18. The eye liner according to claim 17, wherein a minimum length of a diameter of the second region is the same as a maximum length of a section of the first region.

* * * * *